United States Patent [19]

Domogatsky et al.

[11] Patent Number: 5,071,330

[45] Date of Patent: Dec. 10, 1991

[54] ROLLER-VANE HYDRAULIC MACHINE

[76] Inventors: Viktor V. Domogatsky, ulitsa Osipenko, 4/6, kv. I7., Moskoyskaya oblast, Khimki; Boris M. Levin, ulitsa Novolesnaya, I8, kv. 4I., korpus 1 Moscow; Fedor P. Tsurgan, ulitsa Jubileinaya, 35, kv. I0., Moskovskaya oblast, Scherbinka; Yakov Y. Urisman, ulitsa Guryanova, 5I, kv. I67., Moscow; Valentina F. Boiko, B, Akademicheskaya ulitsa, 39V, kv. I8., Moscow; Vyacheslav N. Stobetsky, B. Cherkizovskaya ulitsa, 4, korpus I, kv. 6I., Moscow; Alexandr I. Kravtsov, ulitsa III Internatsionala, 27, kv. I9., Kaluzhskaya oblast, Ljudinovo; Alexei D. Bukhonov, ulitsa Parkovaya, I8/3, kv. 56., Gorkovskaya oblast, Arzamas, all of U.S.S.R.

[21] Appl. No.: 449,887

[22] PCT Filed: Apr. 18, 1988

[86] PCT No.: PCT/SU88/00087

§ 371 Date: Dec. 14, 1989

§ 102(e) Date: Dec. 14, 1989

[87] PCT Pub. No.: WO89/10487

PCT Pub. Date: Nov. 2, 1989

[51] Int. Cl.[5] ..... F04C 2/08; F04C 2/24

[52] U.S. Cl. ..... 418/72; 418/74; 418/102; 418/196

[58] Field of Search ..... 418/71, 73, 74, 80, 418/77, 102, 196, 180, 72

[56] References Cited

U.S. PATENT DOCUMENTS 912,549 2/1909 Fagan ..... 418/180
2,653,551 9/1953 Rosaen ..... 418/74

FOREIGN PATENT DOCUMENTS 802555 2/1981 U.S.S.R. ..... 418/74

*Primary Examiner*—Richard A. Bertsch
*Assistant Examiner*—David L. Cavanaugh
*Attorney, Agent, or Firm*—Burgess, Ryan & Wayne

[57] ABSTRACT

The roller-vane hydraulic machine comprises a hollow casing (1) having working fluid inlet and outlet passages (2, 3). The casing (1) is provided with hollows opening into the space of the casing (1), said hollows accommodating rollers (4) interacting with a rotor (5) located inside of the casing (1). The casing (1) is provided with vanes (6) which, together with the casing (1) form a working space (7) divided by the rollers (4) into larger and smaller inter-roller chambers (8, 9) intercommunicated in pairs by hydraulic relief passages (14, 15). The rollers (4) have slots for the passage of the vanes (6) of the rotor (5). The larger and smaller inter-roller chambers (8, 9) are intercommunicated in pairs by passages (14, 15, 16, 17) in the casing (1).

4 Claims, 3 Drawing Sheets

ROLLER-VANE HYDRAULIC MACHINE

TECHNICAL FIELD

The invention relates to mechanisms serving as a motor or pump wherein the working fluid is liquid or gas and more particularly, it relates to roller-vane hydraulic machines.

BACKGROUND OF THE INVENTION

Known in the prior art is a roller-vane hydraulic machine (SU, A, 567844) comprising a hollow casing with working fluid inlet and outlet passages.

The casing accommodates a rotor with vanes and slotted rollers. The rotor and rollers rotate in synchronism under the effect of the supplied energy. The casing and rotor surfaces form a working chamber divided by rollers into larger and smaller inter-roller chambers. The surfaces of the rollers form sealing clearances together with the surfaces of the casing and rotor. The smaller inter-roller chambers intercommunicate through hydraulic relief passages in the casing. The hydraulic relief of the rotor in the hydraulic machine is incomplete due to the following reason. In the course of rotor rotation there comes a moment when the larger inter-roller chambers get closed. Then the pressure difference in these chambers may reach considerable values.

This brings about a unilateral pressing of the rotor against the casing and a change in the sealing clearances. This leads to increased internal leaks on the working stroke and increased pressure losses on the idle stroke.

The mechanical and volumetric efficiencies of the hydraulic machine depend to a considerable measure upon the length of the rotor vanes since just this length determines the length of contact surface between the rotor and casing in case of rotor pressing and the length of the sealing clearances through which the working fluid passes. As a result, the unilateral pressing of the rotor against the casing reduces the range of rotation frequencies (practically precluding operation at low frequencies) and decreases the service life and reliability of the machine.

Known in the art is another roller-vane hydraulic machine (SU, A, 992821) comprising a hollow casing with working fluid inlet and outlet passages and with hollows which open into the casing space. The hollows accommodate rollers directly interacting with the rotor accommodated inside the casing. The rotor is provided with vanes and, in combination with the casing, forms a working space divided by rollers into larger and smaller inter-roller chambers intercommunicated in pairs through the hydraulic relief radial passages made in the rotor. The rollers have slots for the passage of the rotor vanes, said rotor being installed with a provision for rotating in synchronism with the rollers under the effect of the supplied energy. The surfaces of the rollers form sealing clearances with the surface of the rotor. At the moment when the rollers pass the holes in the radial hydraulic relief passages in the rotor, the sealing clearances formed by the surfaces of the rollers and rotor become radically larger. This brings about a sharp growth of working fluid leaks which may result in stoppages of the rotor or, at the best, in its jerky motion. Operation at low speed in this case becomes impossible due to leaks of the working fluid.

SUMMARY OF THE INVENTION

The main object of the invention resides in providing a roller-vane hydraulic machine wherein the redistribution of the hydraulic relief and selection of the optimum length of the rotor vanes would ensure a wide range of rotor rotation frequencies.

This object is attained by providing a roller-vane hydraulic machine comprising a hollow casing with working fluid inlet and outlet passages and hollows opening into the casing space, said hollows accommodating rollers directly interacting with the rotor accommodated in the casing, having vanes and forming, in combination with the casing, a working space divided by rollers into the larger and smaller inter-roller chambers intercommunicating in pairs through hydraulic relief passages and the rollers have slots for the passage therethrough of the vanes of the rotor installed with a provision for rotating in synchronism with the rollers under the action of the supplied energy wherein, according to the invention, the larger and smaller inter-roller chambers intercommunicate in pairs through hydraulic relief passages in the casing, the geometric centres of holes of said passages being arranged diametrically opposite and lie in the plane normal to the longitudinal plane of symmetry of the casing on the section limited by the planes passing through the geometric centres of the adjacent vanes and through the rotation axis of the rotor.

It is predictable that the larger and smaller inter-roller chambers be intercommunicated in pairs by means of additional hydraulic relief passages located in the longitudinal plane of the rotor body and connecting in pairs the grooves provided on the face surfaces of the rotor.

It is also practicable that the length of the rotor vanes should be selected within a range of 0.8 to 3 roller diameters.

Connecting the larger and smaller inter-roller chambers in twos by the hydraulic relief passages made in the casing and by the additional hydraulic relief passages located in the longitudinal plane of the rotor body and connecting in twos the grooves on the face surfaces of the rotor makes it possible to relieve completely the rotor in the axial and radial directions. The length of the rotor vanes varying from 0.8 to 3 roller diameters ensures serviceability of the hydraulic machine at minimum leaks of the working fluid. This ensures a wider range of rotor rotation frequencies, increase in the efficiency of the hydraulic machine, higher reliability and durability.

BRIEF DESCRIPTION OF THE DRAWINGS

Now the invention will be described by way of example with reference to the accompanying drawings in which.

DETAILED DESCRIPTION OF THE INVENTION

Figure 1:
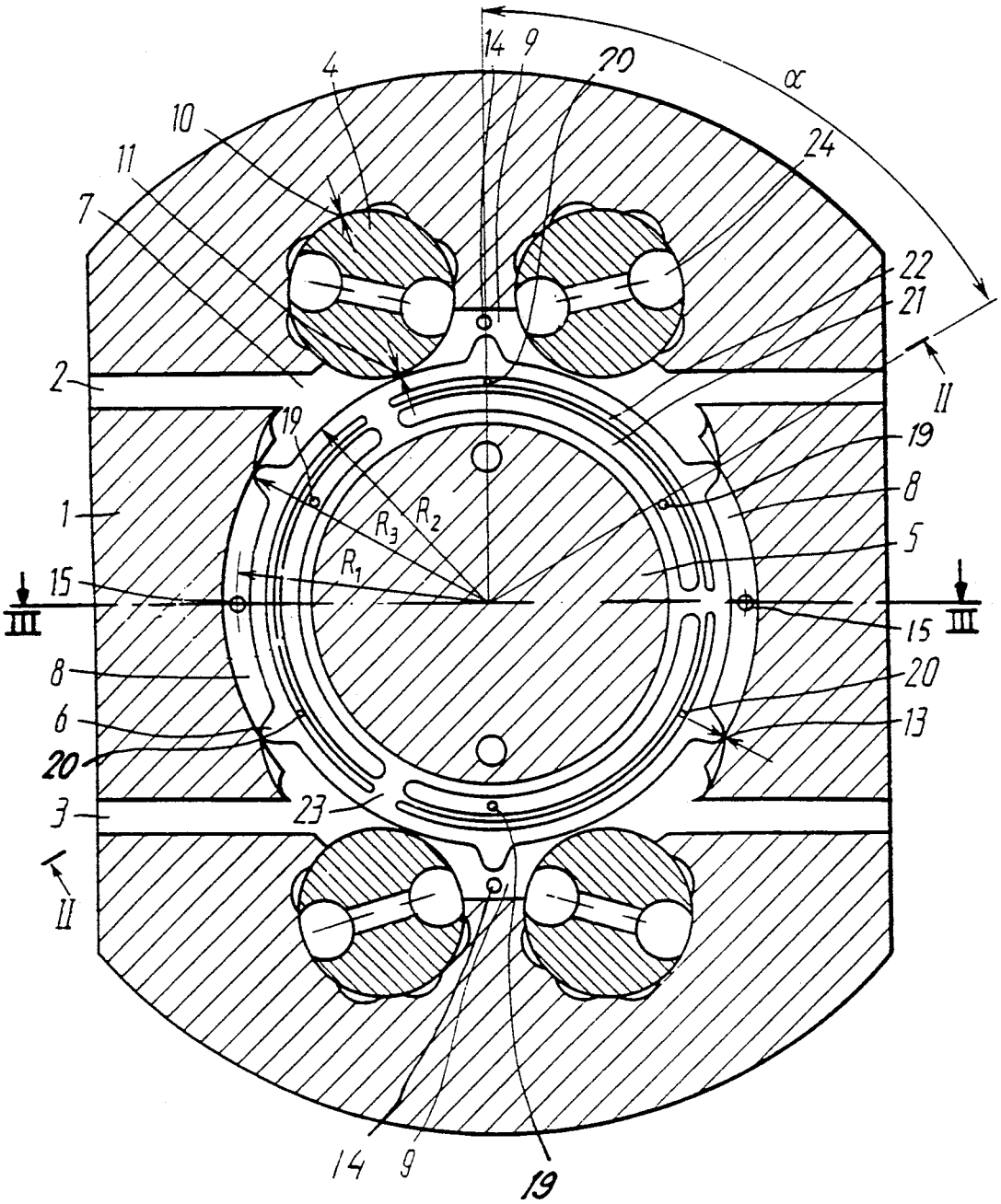
FIG. 1 is a schematic view of the roller-vane hydraulic machine according to the invention, cross section.

The hydraulic machine is comprised of a hollow casing 1 (FIG. 1) provided with working fluid inlet and outlet passages 2, 3 and with hollows opening into the space of the casing 1. The hollows accommodate rollers 4 directly interacting with the rotor 5 located in the casing 1 and provided with vanes 6. The working space 7 is formed by the internal surface of the casing 1 and by the surface of the rotor 5. Said working space 7 is divided by rollers 4 into larger and smaller inter-roller chambers 8, 9.

Figure 2:
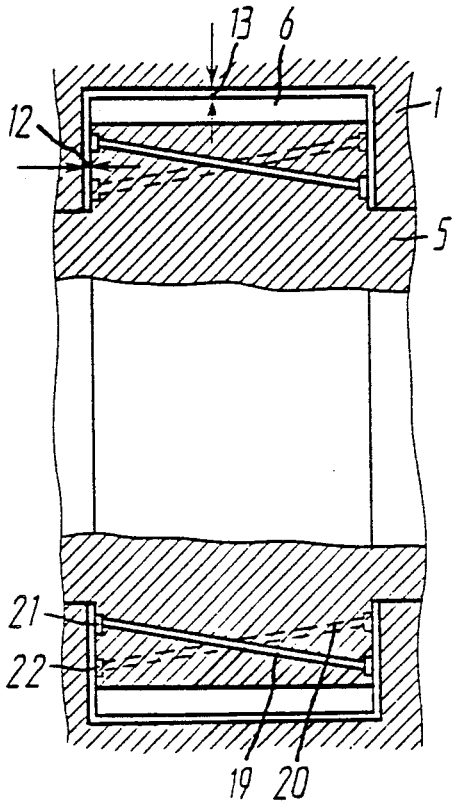
FIG. 2 is a section along line II—II in FIG. 1, longitudinal section.

The surfaces of rollers 4 in combination with the surface of the casing 1 form sealing clearances 10 while in combination with the surface of the rotor 5 they form sealing clearances 11. The surface of the casing 1 in combination with the surface of the rotor 5 forms face sealing clearances 12 (FIG. 2) while in combination with the surface of vanes 6 it forms sealing clearances 13 (FIG. 1).

The rotor 5 has six vanes 6 (most preferable layout). The angle $\alpha$ formed by the sections of straight lines passing through the geometrical centres of the adjacent vanes 6 and through the rotation axis of the rotor 5 is equal to 60°. However, other layouts of the hydraulic machine are also possible, for example with 4, 8, 10 etc. vanes for which this angle is, respectively, 90°, 45°, 36°, etc.

Figure 3:
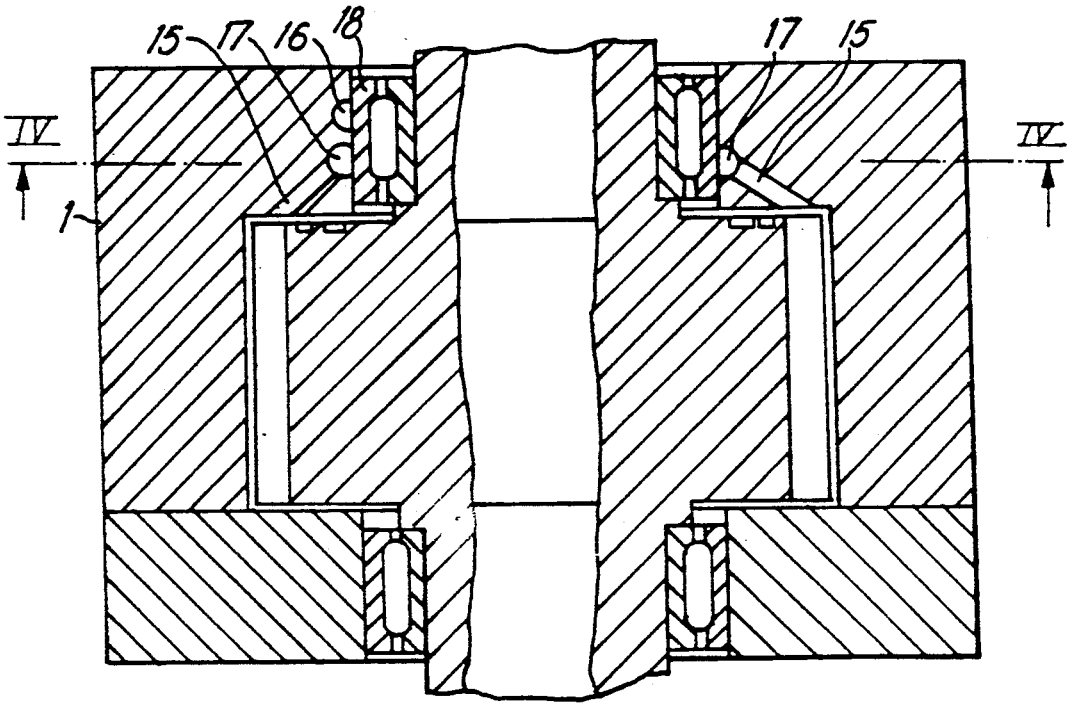
FIG. 3 is a longitudinal sectional view taken along line III—III in FIG. 1.

The larger and smaller inter-roller chambers 8, 9 are intercommunicated in twos by passages 14, 15 (FIG. 1), 16, 17 (FIG. 3) intended for radial hydraulic relief of the rotor 5. The hydraulic relief passages 14, 15 (FIG. 1) are made in the casing 1 and intercommunicated in twos by passages 16, 17 (FIG. 3).

The passages 16, 17 are made between the casing 1 and the outer races of bearings 18. The holes of the passages 14, 15 (FIG. 1) are located on the radius $R_1$ whose value varies from $R_2<R_1<R_3$ where $R_2$=rolling radius of the rotor 5, $R_3$=radius of the roller 4 over the vanes 6. The hydraulic relief passages 14, 15 are connected in twos, arranged diametrically opposite and their axes lie in the plane passing through the rotation axis of the rotor 5. The diameter of holes in the passages 14, 15 should not exceed the width of the vanes 6 on the $R_1$ radius otherwise the pressures at the inlet and outlet of the machine may become combined. The passages 15 may be made in one or more pairs. The passages 16, 17 (FIG. 3) may be in other parts, such as, for example, in the journals of the rotor 5. The geometrical centres of holes in the hydraulic relief passages 14, 15 (FIG. 1) lie in the plane normal to the longitudinal symmetry plane of the casing 1. The geometrical centres of the passages 15 lie on the section limited by the planes passing through the geometrical centres of adjacent vanes 6 and the rotation axis of the rotor 5.

The passages 14, 15, 16, 17 (FIG. 1, FIG. 3) are made so as to ensure radial relief of the rotor 5 in any position it occupies relative to the casing 1 and rollers 4 by communicating the smaller inter-roller chambers by passages 14 and further, through passages 16, and communicating the larger inter-roller chambers by passages 15 and further through passages 17.

The passages 15 may be arranged both on the symmetry axis of the hydraulic machine and in any interval of the angle $\alpha$. The paired passages 15 are always located diametrically opposite and their axes lie in the plane passing through the rotation axis of the rotor 5.

Additional hydraulic relief passages 19, 20 (FIG. 1) are arranged in the body of rotor 5 and connect in pairs circular grooves 21, 22 (FIG. 1, FIG. 2) made on the end faces of the rotor 5. The grooves 21, 22 are of the intermittent design. The intermittent shape of grooves 21, 22 improves the efficiency of hydraulic relief since it has a substantial effect on restoring the plane-parallel configuration of the face sealing clearance 12 if it has previously been of the conical shape. The grooves 21, 22 may also be continuous. However, the intermittent shape of the grooves 21, 22 is preferable since the continuous groove will prove efficient only with the plane-parallel face sealing clearance 12 and is ineffective if said clearance 12 has previously been conical. The grooves 21 of a larger area are located nearer to the axis of the rotor 5. The grooves 22 of a smaller area are interconnected by the hydraulic relief passages 19, 20 located in a longitudinal plane of the body of the rotor 5 with the grooves 21 of a larger area located on the opposite face ends of the rotor 5. The number of grooves 21, 22 on each face surface of the rotor 5 must be not less than one (in this case it should be fully circular). It is practicable that the number of grooves 21 and 22 should be not less than two or three on each face of the rotor 5. The grooves 21, 22 may be made on the face surfaces of the casing 1. However, the provision of the grooves 21, 22 on the face surfaces of the rotor 5 is preferable for the following reason. If the grooves 21, 22 are made on the face surfaces of the rotor 5, the passages 19, 20 during its rotation are not overlapped by bridges 23 (FIG. 1) between the adjacent grooves 21 or 22 (FIG. 2) as would have happened if the grooves 21, 22 were made on the face surfaces of the casing 1.

The provision of passages 19, 20 in the rotor 5 intercommunicating the grooves 21, 22 ensures axial hydraulic relief of the rotor 5 of the hydraulic machine which excludes the endwise pressing of the rotor 5 against the casing 1 and changes of the face sealing clearances 12 whose value determines to a considerable extent the leaks of the working fluid and, consequently, the range of rotation frequencies of the rotor 5.

The axial hydraulic relief of the rotor 5 contributes to increasing the efficiency, reliability and durability of the hydraulic machine. The rollers have slots 24 (FIG. 1) for the passage of the vanes of the rotor 5 which is installed with a provision for synchronous rotation with the rollers 4 under the action of the supplied energy. The length 1 of the vanes 6 of the rotor 5 (FIG. 2) is selected within 0.8 to 3 diameters of the roller 4.

This length of the vanes 6 of the rotor 5 ensures efficient service of the hydraulic machine with minimum leaks of the working fluid, thereby broadening the range of the rotor rotation frequencies and raising the efficiency of the machine. Selection of this length of the vanes 6 of the rotor 5 is explained by the following. If the length 1 of the vanes 6 of the rotor 5 is larger than 3d where d=diameter of the roller 4, the total length of the recess (including the recess for the bearing 18) will be $l>5d$ which is difficult technologically. Besides, the length of the vanes 6 exceeding 3d results in larger face sealing clearances 12. This goes together with increased leaks of the working fluid and, consequently, with a reduction of the range of rotation frequencies and the efficiency of the machine.

The length of the vanes 6 smaller than 0.8d is not recommended for the following reason. The working volume $V_o$ of the hydraulic machine can be found from the expression $$V_o = \frac{\pi}{2}(D_1^2 - D_2^2)l$$

$D_1$=diameter of the rotor 5 over its vanes 6; $D_2$=rolling diameter of the rotor 5. The required working volume can be obtained either by increasing the length of the vanes 6 or by increasing the diameter of the rotor 5. The second method is less acceptable since it results in an unwarranted development of the face sealing clearances 12 which, in turn, leads to heavier leakage of the working fluid and, as a consequence, to a narrower range of rotation frequencies and a lower efficiency of the machine.

The hydraulic machine according to the invention functions as follows.

Figure 4:
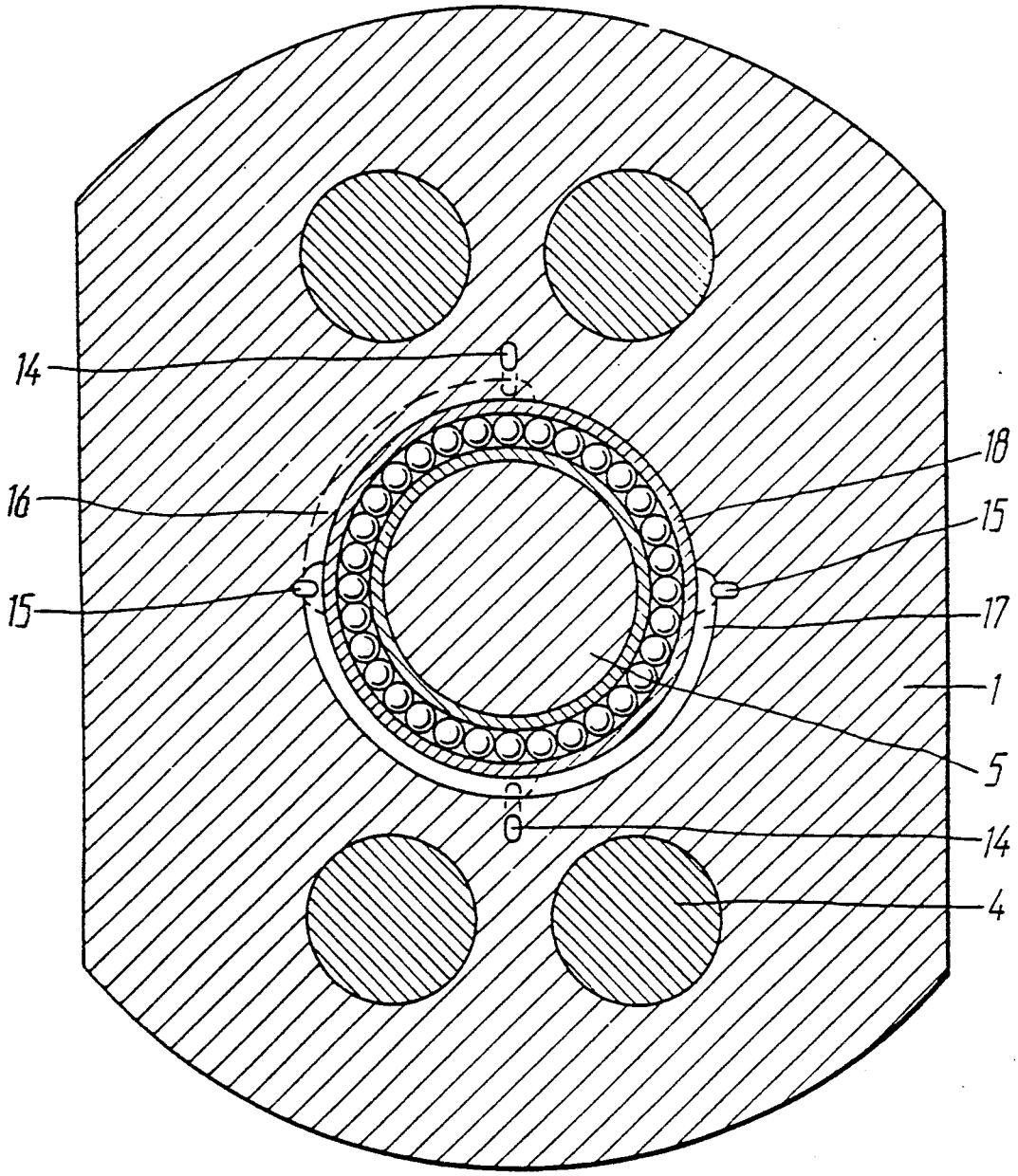
FIG. 4 is a Section along line IV—IV in FIG. 3.

The rotor 5 (FIG. 1) with the vanes 6 is rotated by the supplied energy, conveying the working fluid into the passage 3. Rotation of the rotor 5 is accompanied by rotation of the rollers 4 in synchronism with the rotor. The hydraulic machine has an even number of rollers 4, two larger inter-roller chambers 8 and two smaller inter-roller chambers 9, arranged diametrically opposite to the rotation axis of the rotor 5. In the course of rotation, one group of rollers 4 lets pass the vanes 6 while the remaining rollers 4 in combination with the surface of the casing 1 form a sealing clearance 10 and, in combination with the rotor surface, a sealing clearance 11. The surface of the casing 1 in combination with the surfaces of the vanes 6 forms sealing clearances 13. The sealing clearances 10, 11, 12, 13 (FIG. 1, FIG. 2) divide pressure at the inlet 2 and outlet 3 (FIG. 1). Simultaneously, the rotor 5 is axially and radially relieved. The radial relief of the rotor 5 is carried out by connecting in pairs the larger and smaller inter-roller chambers 8, 9 by hydraulic relief passages 14, 15 (FIG. 1, FIG. 3 and FIG. 4) and 16, 17 made in the casing 1.

Axial relief of the rotor 5 (FIG. 1) is carried out by way of connecting the larger and smaller inter-roller chambers 8, 9 through hydraulic relief passages 19, 20 (FIG. 2) which connect the grooves 21, 22 (FIG. 1) on the end faces of the rotor 5.

Investigations of four typesizes of hydraulic machines with working volumes $V_o$=40, 125, 1800 and 2000 $cm^3$/vol have revealed that said hydraulic machines rendered steady service both in the motoring and pumping modes at the rotation frequencies of the rotor 5 ranging from 0.1 to 3000 rpm including servo operation on oils with a viscosity range of 1-2000 $mm^2$/s. Featuring a high efficiency within a wide range of rotation frequencies and working pressures, these hydraulic machines develop considerable torques at a small size and specific mass per unit of the working volume $V_o$. These machines ensure a constant torque on the rotor shaft in any position of the rotor and either direction of its rotation.

The machines combine such hard-to-combine features as high torque and speed.

INDUSTRIAL APPLICABILITY

The present invention will prove most effective in servo systems within a broad range of rotation frequencies. It can also be used in air motors, compressors and internal combustion engines.

We claim:

1. A roller-vane hydraulic machine having pressure balancing, comprising: a casing with working fluid inlet and outlet passages, a space and an interior surface; at least two hollows opening into the space of the casing; a rotor arranged in the space of the casing, the rotor having vanes and an axis of rotation, said vanes defining a working volume between the rotor and the casing; a roller disposed in each hollow of the casing, the roller directly interacting with the rotor, each roller having at least one slot for passing the vanes of the rotor, when the rotor is rotated in unison with the rollers; first and second hydraulic relief passages with openings provided in the casing, geometric centers of the openings being diametrically opposite and disposed in a plane perpendicular to a longitudinally extending axis of symmetry of the casing and passing through the geometric axis of rotation of the rotor; large and small inter-roller chambers formed in the working volume by the rollers wherein the small roller chambers are in fluid communication first by the hydraulic relief passages and the large roller chambers are in fluid communication by the second hydraulic relief passages.

2. A roller-vane hydraulic machine of claim 1, comprising: A first circular groove and a second circular groove disposed coaxially on each end face of the rotor, the first groove being arranged nearer the geometric axis of the rotor and having a greater area than the second groove being arranged further from the geometric axis of the rotor; at least two third hydraulic relief passages arranged in the rotor, each of the third hydraulic relief passages in the rotor connecting the first groove on one end face of the rotor with the second groove on the other end face of the rotor.

3. A roller vane hydraulic machine of claim 2 wherein the length of the vane is equal to 0.8 to 3 diameters of the rollers.

4. A roller vane hydraulic machine of claim 1 wherein the length of the vanes is equal to from 0.8 to 3 diameters of the rollers.

* * * * *